US007073686B2

(12) United States Patent
Hanell

(10) Patent No.: US 7,073,686 B2
(45) Date of Patent: Jul. 11, 2006

(54) POURING SPOUT

(76) Inventor: Edward G. Hanell, 2457 Louella Ave., Venice, CA (US) 90291

( * ) Notice: Subject to any disclaimer, the term of this patent is extended or adjusted under 35 U.S.C. 154(b) by 386 days.

(21) Appl. No.: 10/619,903

(22) Filed: Jul. 15, 2003

(65) Prior Publication Data

US 2005/0011909 A1 Jan. 20, 2005

(51) Int. Cl.
*B67D 5/00* (2006.01)

(52) U.S. Cl. ..... 222/83.5; 222/541.2; 220/267; 229/204

(58) Field of Classification Search ..... 222/541.5, 222/5, 525, 80–90, 241.5, 556, 541.2; 220/267; 229/204

See application file for complete search history.

(56) References Cited

U.S. PATENT DOCUMENTS 1,325,828 A * 12/1919 Becker-Jurgen et al. ..... 222/90
1,826,838 A * 10/1931 Stump et al. ..... 222/90
3,258,168 A 6/1966 Koehler, Jr.
3,599,836 A 8/1971 Hegi
3,602,396 A 8/1971 Oates
3,961,732 A 6/1976 Roberts
3,964,640 A 6/1976 Laughlin
4,009,805 A 3/1977 Klygis et al.
4,150,768 A 4/1979 Maynard, Jr.
4,205,757 A 6/1980 Jurgens
4,271,983 A * 6/1981 Takemura et al. ..... 222/85
4,399,929 A 8/1983 Scaglione
4,446,989 A 5/1984 Brannen
4,881,662 A 11/1989 Tallman
5,020,690 A * 6/1991 Kishikawa et al. ..... 222/83
5,147,070 A * 9/1992 Iwamoto ..... 222/83
5,195,662 A 3/1993 Neff
5,213,239 A 5/1993 Macaluso
5,249,708 A 10/1993 Magness
5,366,114 A 11/1994 Bernsrtein et al.
5,573,047 A 11/1996 Akin
5,579,963 A 12/1996 Murthi
5,960,992 A * 10/1999 Bernstein et al. ..... 222/83.5
6,003,715 A 12/1999 Harris

* cited by examiner

*Primary Examiner*—Michael Mar
*Assistant Examiner*—Melvin Cartagena
(74) *Attorney, Agent, or Firm*—John S. Christopher

(57) ABSTRACT

A pouring spout for use in providing a conduit for the discharge of the contents of a closed container containing fluids or granulated materials includes a cylindrical inner housing having an open top end and a removable tethered cap. A pair of opposing punch blades affixed to the cylindrical inner housing is provided for insertion into a top surface of a container where the cylindrical inner housing and the punch blades serve to provide a discharge conduit for the container. A projection spur is formed on each of the punch blades for forcing open the top surface of the container. An outer safety sleeve is provided for covering the punch blades when the punch blades are withdrawn from the top surface of the container.

20 Claims, 4 Drawing Sheets

POURING SPOUT

BACKGROUND OF THE INVENTION

1. Technical Field

The present invention relates to pouring spouts for containers. More specifically, the present invention relates to methods and apparatus for a pouring spout having a removably capped, cylindrical inner housing in combination with a pair of stainless steel opposing punch blades for insertion into a closed container, the spout serving as an exit conduit for the container contents, where an outer safety sleeve is provided to cover the punch blades when the spout is not in use.

2. Background Art

Opening containers which contain liquid or granular material while simultaneously avoiding spillage has always posed a challenge to the tradesman in the work environment. Containers, typically of the gallon and quart variety, which contain fluids, paints, water seals, granular materials and the like usually include a top lid. Often, the container lid will include a lip or edge which is designed to facilitate the opening of the contain with a common tool such as, for example, a screw driver. A typical example of this situation is the standard gallon of paint which includes a lid having a lip formed in the top thereof. It is common practice to insert the edge of a screwdriver into the lip formed in the top of the paint can lid. By applying a downward force to the handle of the screwdriver, an upward force is mechanically transferred to the lid of the paint can. Upon application of a sufficient force, the lid can be removed from the paint can.

Once the lid is removed from the paint can, spillage of the contents is very common. For example, the bottom of the paint can lid is covered with paint or other fluid contained therein. Thus, it is important to have prepared a location to temporary store the paint can lid while the painting task is being completed. Once the paint can has been opened, a measured amount of paint or other fluid is removed from the paint can since it is not common to draw paint onto a brush directly from the gallon paint can. If interior painting is being performed, it is more common to paint flat surfaces with a roller apparatus. Thus, a certain volume of the paint must be dispensed from the gallon paint can into a second container such as a roller pan. This is the case since the gallon paint container cannot accommodate the larger roller apparatus utilized to transfer the paint to the flat surface. It is during the transfer of the volume of paint from the gallon container to the roller pan that spillage most often occurs. Even if the proper procedures are followed, i.e., the use of plastic drop clothes and other protective means, spillage of the paint while pouring from the paint container into the roller pan is very common. This situation often results in an unsatisfactory mess and wasted time since the spillage obviously must be contained immediately.

Attempts in the past to rectify this spillage problem resulted in the development of several prior art pouring mechanisms. For example, U.S. Pat. No. 3,599,836 to Hegi on Aug. 17, 1971 entitled Pourer Tube For Fluid Containers discloses a cylindrical plastic tube 1, with an open top, removable lid 5 positioned on the tube 1, a piercing stem 3 with a piercing point 4, an abutment flange 2 and a sealing ring 7. Oblique surfaces 12 were also provided for stabilizing the pourer tube for fluid containers. U.S. Pat. No. 4,881,662 to Tallman on Nov. 21, 1989 discloses a plastic tubular body 11 having an open top, a reclosure cap 17 attached to a tether 55, a tubular steel penetrating member 12, a rubber gasket 13 and a plastic washer 14 for sealing, and a rotating and locking ring 16 with a threaded portion 60, 62 for stabilizing the dispensing spout. U.S. Pat. No. 4,150,768 to Maynard, Jr. on Apr. 24, 1979 discloses a plastic pouring spout 30 having a closure plug 43 and including a metal tubular container top piercing blade 31, spaced lugs 37 as a bearing surface, and where the piercing blade 31 serves to displace a flap 34 of punched metal in the container top, and a compressible gasket 38 for sealing against leakage.

Many references disclose a tubular or cylindrical housing with a removable cap and a singular steel punching blade. For example, a cylindrical plastic housing is disclosed by U.S. Pat. No. 5,249,708 to Magness (tube member 16), U.S. Pat. No. 4,446,989 to Brannen (metallic cutter dispenser tubing 11), and U.S. Pat. No. 4,205,757 to Jurgens (pouring spout shown in FIGS. 1, 2). Additionally, a raised ring stop is disclosed by U.S. Pat. No. 6,003,715 to Harris (stop surface 34) and singular punching blades are also disclosed by U.S. Pat. No. 4,446,989 to Brannen (metallic cutter dispenser blade 16), U.S. Pat. No. 4,205,757 to Jurgens (metallic cutter 18), and U.S. Pat. No. 3,964,640 to Laughlin (cutter portion 12). However, no patent or combination of patents discovered teaches or discloses either individually or in combination the use of a pair of opposing stainless steel punch blades, projection spurs, locking notches, and a sliding plastic safety sleeve in combination with the pouring spout construction.

Thus, there is a need in the art for a pouring spout comprising a cylindrical inner housing having an open top in combination with a pair of opposing stainless steel punch blades for insertion into a top lid of a closed container for providing a conduit for the discharge of the contents therein, where the pair of punch blades each include a projection spur to force open that portion of the top lid sliced open by the insertion of the punch blades, a pair of locking notches for enabling the punch blades to bite into the top lid, and an outer safety sleeve for covering the pair of punch blades when the pouring spout is not in use.

DISCLOSURE OF THE INVENTION

Briefly, and in general terms, the present invention provides a new and improved pouring spout for providing a conduit for the discharge of the contents of a closed container containing, for example, fluids or granulated materials. In particular, the inventive pouring spout facilitates the removal of liquid materials typically used in the building and construction industry such as, for example, paint. The invention enables measured volumes of, for example, paint, to be removed from the closed container which can be a standard gallon container. Insertion of the inventive pouring spout into a top surface or lid of the closed container enables the measured volume of paint to be dispensed to a second container, such as a roller pan, without the spillage typically associated with removing paint from a gallon container.

In a preferred embodiment, the pouring spout can comprise a cylindrical inner housing having an open top end in combination with a pair of opposing stainless steel punch blades for insertion into the top surface or lid of the closed container. Each of the punch blades include a projection spur formed thereon to force open that portion of the top lid that has been sliced open by the insertion of the punch blades. Each of the punch blades also can include a locking notch for enabling each punch blade to bite into the top lid for providing a more secure grip. Additionally, the present invention is fitted with an outer safety sleeve for covering the pair of opposing punch blades when the pouring spout is not in use. A removable cap tethered to the outer safety sleeve is provided for closing the open top end to seal the container once the punch blades have been inserted therein.

The cylindrical inner housing also includes an anti-drip collar which serves to prevent drainage or dripping of paint once the pouring operation has ceased. Further, the anti-drip collar also functions to secure the removable cap to the pouring spout. A plurality of guide ribs are formed onto the external surface of the cylindrical inner housing which are intended to cooperate with a corresponding plurality of slots formed in a top ring, attached to the top of the outer safety sleeve. The guide ribs serve to keep the outer safety sleeve aligned with the cylindrical inner housing and to provide an interference fit there between. A raised ring is formed on the bottom of the cylindrical inner housing to serve as a stop when the cylindrical inner housing reaches the top surface or lid of the closed container during insertion of the punch blades. A seal washer is positioned between the raised ring and the top surface or lid of the closed container to prevent leakage of paint at that interface.

The plurality of projection spurs are each comprised of stainless steel and are formed by piercing each of the respective punch blades with a piercing tool. During insertion of the punch blades into the top surface or lid of the closed container, each projection spur contacts and forces down that portion of the top lid sliced by the punch blades. This design results in a pair of D-shaped or half-moon shaped openings in the top lid of the closed container for enabling the removal of the paint therein. Each of the locking notches formed in the punch blades can be rectangular-shaped and include a serrated edge to assist the respective punch blade to bite into the top surface or lid of the closed container for providing a more secure grip. The outer safety sleeve is vertically movable along the cylindrical inner housing and the guide ribs formed on the cylindrical inner housing provide an interference fit with the outer safety sleeve. The outer safety sleeve also includes a stabilizer flange to enable the pouring spout to stand vertically when not in use.

The present invention is generally directed to a pouring spout for providing a conduit for the discharge of the contents of a closed container containing, for example, fluids or granulated materials and enables measured volumes thereof to be removed from the closed container. In its most fundamental embodiment, the pouring spout includes a cylindrical inner housing having an open top end and a removable tethered cap. A pair of opposing punch blades affixed to the cylindrical inner housing is provided for insertion into a top surface of a container where the cylindrical inner housing and the punch blades serve to provide a discharge conduit for the container. A projection spur is formed on each of the punch blades for forcing open the top surface of the container. An outer safety sleeve is provided for covering the punch blades when the punch blades are withdrawn from the top surface of the container.

These and other objects and advantages of the present invention will become apparent from the following more detailed description, taken in conjunction with the accompanying drawings which illustrate the invention, by way of example.

DETAILED DESCRIPTION OF THE INVENTION

Figure 1:
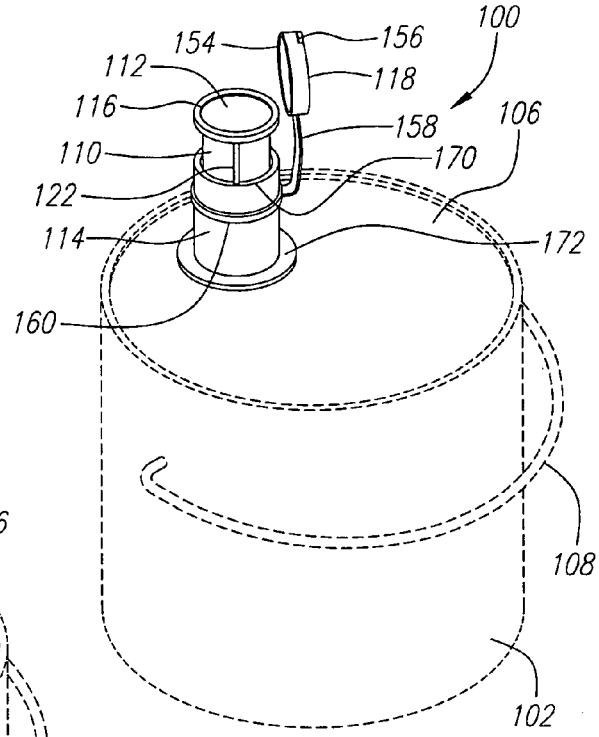
FIG. 1 is a perspective view of a pouring spout of the present invention shown mounted on the top lid of a paint can and showing an outer safety sleeve including a stabilizer flange mounted on the paint can lid, the safety sleeve surrounding a cylindrical inner housing which is shown in the withdrawn position and a tethered removable cap shown in the open position.

The present invention is a pouring spout 100 intended to provide a discharge conduit for the contents of a closed container 102 which can contain, for example, liquids or granulated materials 104. The liquids or granulated materials 104 might be typically employed in the building or construction industry where a suitable example is paint or other pourable liquid. Thus, the inventive pouring spout 100 can facilitate the removal of the paint from the closed container 102 in measured volumes. It is noted that the closed container 102 can be a standard gallon paint container having a removable top surface or lid 106 typically removed with a common tool such as a screwdriver. Manual insertion of the inventive pouring spout 100 into the top surface or lid 106 of the closed container 102 enables a measured volume of the liquid or granulated material 104, i.e., the paint, to be dispensed from the closed container 102 to a second container such as a roller pan (not shown). By utilizing the pouring spout 100 of the present invention, this task can be performed without spillage that is typically associated with the removal of paint from a gallon container.

Figure 2:
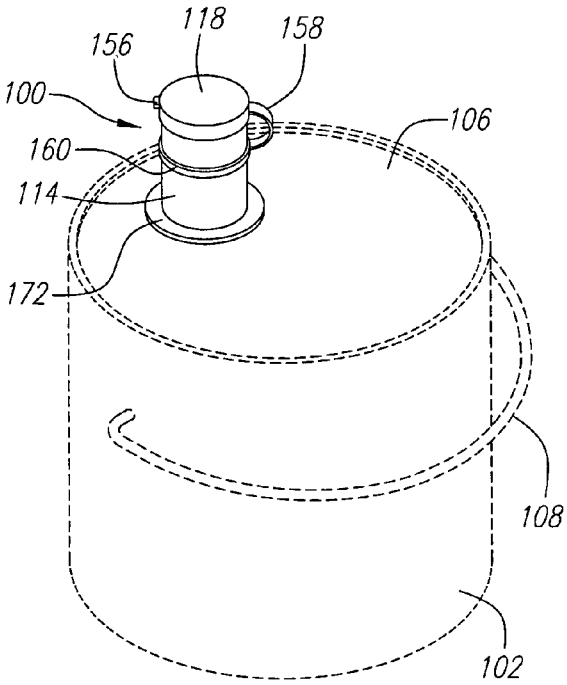
FIG. 2 is a second perspective view of the pouring spout of FIG. 1 shown mounted in the paint can lid with the stabilizer flange of the outer safety sleeve mounted thereon, the cylindrical inner housing shown in the lowered position and the tethered removable cap shown in the closed position.
Figure 3:
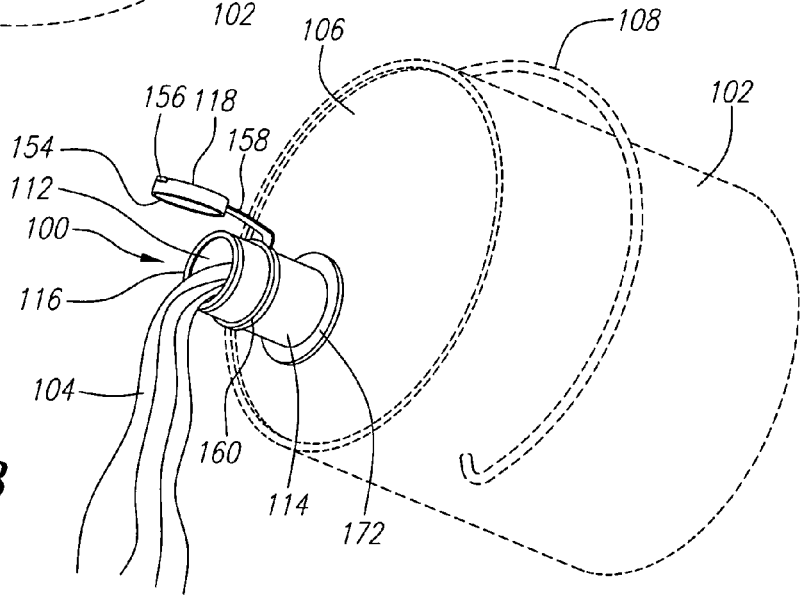
FIG. 3 is a third perspective view of the pouring spout of FIG. 1 shown mounted in the paint can lid with the stabilizer flange located flush therewith and the cylindrical inner housing shown in the lowered position and the removable cap shown in the open position, the paint can shown tilted to enable the contents to be poured out of the pouring spout.

A preferred embodiment of the pouring spout 100 of the present invention will now be described in detail. The pouring spout 100 in association with the closed container 102, illustrated in phantom as a standard gallon paint container having a handle 108, is clearly shown in FIGS. 1–3. In FIG. 1, the closed paint container 102 is shown in an upright position with the pouring spout 100 positioned to be inserted into the top surface or lid 106. In FIG. 2, the pouring spout 100 is shown mounted within the top lid 106 of the paint container 102, the container 102 also shown in the upright position. However, in FIG. 3, the paint container 102 is shown in a tilted position with the pouring spout 100 also shown mounted within the top lid 106. The position of the paint container 102 and the pouring spout 100 illustrated in FIG. 3 facilitates the discharge of the contents, i.e., the liquid paint 104; from within the paint container 102. Note that the paint 104 can be conveniently removed from the paint container 102 without removing the top lid 106 and without the spillage and mess typically associated with removing the paint 104 from the standard gallon paint container 102.

Figure 4:
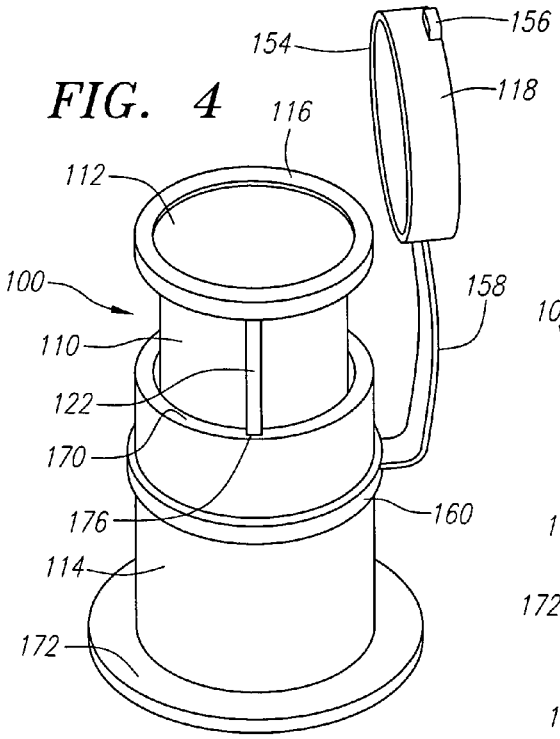
FIG. 4 is a fourth perspective view of the pouring spout of FIG. 1 showing the cylindrical inner housing withdrawn above the safety sleeve and stabilizer flange, the tethered removable cap shown in the open position.
Figure 8:
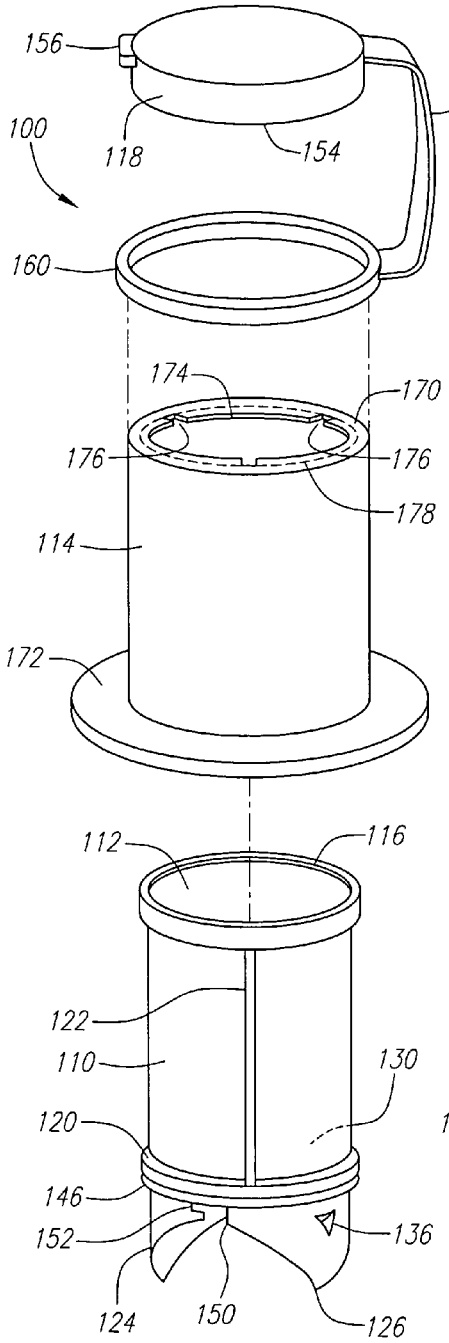
FIG. 8 is an exploded view of the pouring spout of FIG. 1 showing the outer safety sleeve and stabilizer flange separated from the cylindrical inner housing, the inner housing including a plurality of ribs and a raised ring formed thereon, and a seal washer positioned around the stainless steel opposing punch blades, the removable cap shown in the open position.

In a preferred embodiment, the pouring spout 100 includes a cylindrical inner housing 110 having an open top end 112 as is best shown in FIGS. 4 and 8. The cylindrical inner housing 110 can be comprised of plastic and serves as the main conduit for the transfer of the liquid paint 104 from the closed paint container 102 to a separate container such as a roller pan (not shown). Additionally, the cylindrical inner housing 110 can serve as the main conduit for the transfer of granulated material from the closed container 102 to a separate container for mixing or the like. The granulated material can be, for example, construction granulated materials or even agriculture grains, seeds or the equivalent. The cylindrical inner housing 110 shown, for example, in FIG. 4 is surrounded by an outer safety sleeve 114 which is employed as a safety mechanism as will be clearly described herein below.

A more detailed description of the cylindrical inner housing 110 is best accomplished by referring to FIG. 8. FIG. 8 illustrates an exploded view of the pouring spout 100 including the cylindrical inner housing 110. In particular, the cylindrical inner housing 110 is, illustrated as the bottom component shown on FIG. 8 and comprises an anti-drip collar, lip or bead 116 formed on the top thereof. The anti-drip collar 116 can be, for example, formed to the top of the cylindrical inner housing 110 as by plastic molding during the manufacturing stage. The anti-drip collar 116 serves to prevent drainage or dripping of the liquid paint 104 from the pouring spout 100 once the pouring operation has ceased. Additionally, the anti-drip collar 116 functions as a means for, receiving and securing a tethered removable cap 118 employed to close the open top end 112 of the pouring spout 100 as is shown in the accompanying FIGS. 2, 6, 7 and 13. The lip or bead construction of the anti-drip collar 116 includes sufficient thickness so that some manual force is necessary to apply the removable cap 118 onto the collar 116 to close the open top end 112. This design keeps the removable cap 118 securely attached to the anti-drip collar 116 until the removable cap 118 is physically removed.

Figure 9:
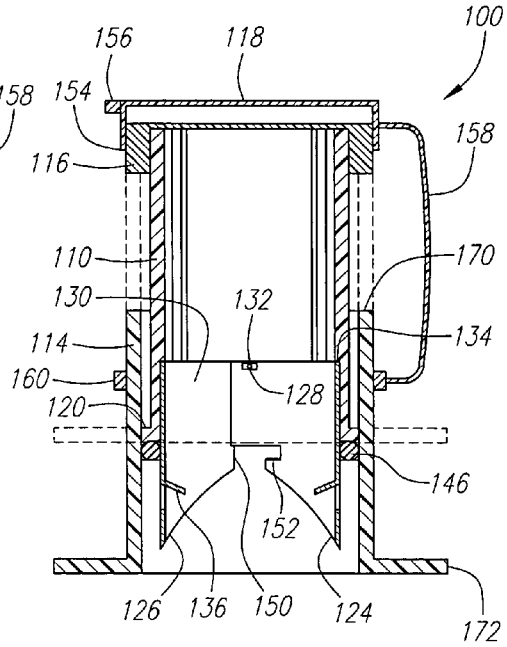
FIG. 9 is a cross-sectional view of the pouring spout of FIG. 1 taken along the line 9—9 of FIG. 6 and showing the cylindrical inner housing withdrawn above the outer safety sleeve and stabilizer flange with the pair of stainless steel opposing punch blades and pair of corresponding projection spurs shrouded by the safety sleeve, the removable cap shown in the closed position.
Figure 10:
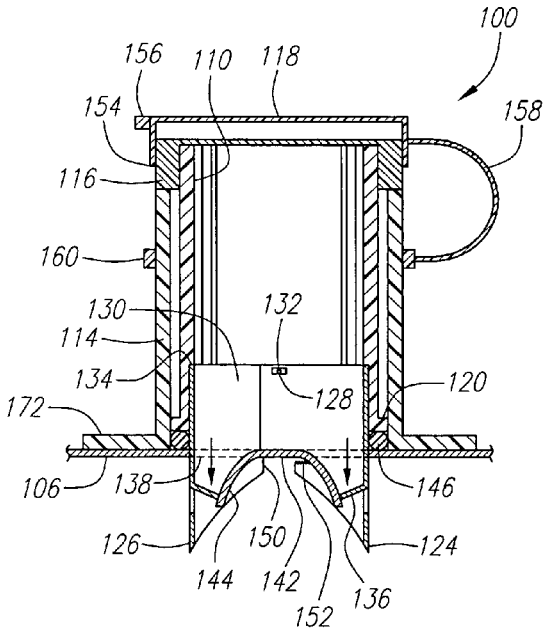
FIG. 10 is a cross-sectional view of the pouring spout of FIG. 2 taken along the line 10—10 of FIG. 7 and showing the cylindrical inner housing in the lowered position surrounded by the outer safety sleeve, with the pair of stainless steel punch blades and corresponding projection spurs extending down below the safety sleeve and stabilizer flange for forcing an opening in the paint can lid, the removable cap shown in the closed position.

Located at the bottom of the cylindrical inner housing 110 is a raised ring 120. The raised ring 120 is formed to the bottom of the cylindrical inner housing 110 as by, for example, plastic molding during the manufacturing stage much like that described for the anti-drip collar 116. The raised ring 120 is designed to function as a stop at the bottom of the cylindrical inner housing 110 when the raised ring 120 reaches the top lid 106 of the paint container 102 during insertion of the pouring spout 100 as shown in FIG. 10. The raised ring 120 also cooperates with the construction of the outer safety sleeve 114 to stop the downward motion thereof to prevent the safety sleeve 114 from sliding off of the cylindrical inner housing 110 as is shown in FIG. 9. These features will be described in more detail once the full construction of the outer safety sleeve 114 is disclosed herein below. Formed on the outer surface of the cylindrical inner housing 110 and extending between the anti-drip collar 116 and the raised ring 120 is a plurality of guide ribs 122. The guide ribs 122 are intended to cooperate with the construction of the outer safety sleeve 114 for keeping the outer safety sleeve 114 aligned with the cylindrical inner housing 110. Further, the plurality of guide ribs 122 serve to provide an interference fit, i.e., a cohesive frictional attachment, between the outer safety sleeve 114 and the cylindrical inner housing 110. The guide ribs 122 can be formed onto the exterior surface of the cylindrical inner housing 110 as by molding in plastic. Each of the plurality of guide ribs 122 extends outward from the exterior surface of the cylindrical inner housing 110 at a distance equal to the distance that the raised ring 120 extends outward from the cylindrical inner housing 110. Although the number of guide ribs 122 can be varied, it is anticipated that the preferred embodiment should include three guide ribs 122 located every one-hundred-twenty mechanical degrees about the circumference of the cylindrical inner housing 110 as is indicated in FIG. 8.

Figure 11:
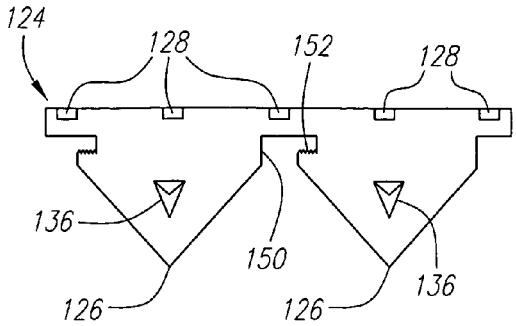
FIG. 11 is a detail planar view of the pair of stainless steel opposing punch blades illustrating a projection spur formed in each punch blade and further including a pair of locking notches each having a serrated edge, and fastener penetrations.
Figure 12:
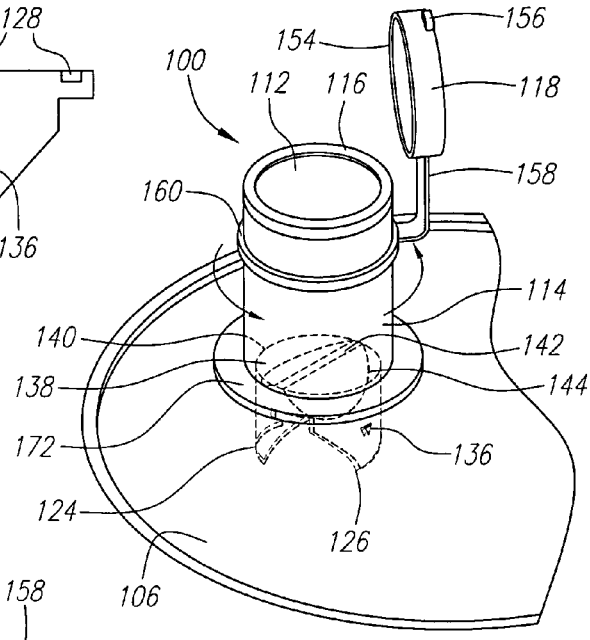
FIG. 12 is a perspective view of the pouring spout of FIG. 2 shown with the stabilizer flange mounted upon and the pair of stainless steel punch blades (in phantom) extending through the paint can lid with the cylindrical inner housing lowered within the outer safety sleeve, the removable cap shown in the open position.

Mounted to the bottom of the cylindrical inner housing 110 is a pair of opposing stainless steel punch blades 124 employed for the forceful insertion of the pouring spout 100 into the top surface or lid 106 of the closed paint container 102 as is best shown in FIGS. 8 and 12. The punch blades 124 can be fashioned from a single piece of stainless steel sheet metal as is shown in FIG. 11 and then mounted to the bottom inner surface of the cylindrical inner housing 110. The pair of punch blades 124 will typically have a corresponding pair of pointed ends 126 so that when force is applied to the pouring spout 100, the punch blades 124 will each pierce the top lid 106 as shown in FIG. 12.

The pair of opposing punch blades 124 are attached to the cylindrical inner housing 110 in the following manner. In the preferred embodiment, the single piece of stainless steel sheet metal shown in FIG. 11 that is utilized to fashion the punch blades 124 also includes a plurality of rectangular penetrations 128 formed therein. The construction of the interior of the cylindrical inner housing 110 is designed to accommodate the attachment of and provide support to the punch blades 124. Formed on the lower interior surface 130 of the cylindrical inner housing 110 is a plurality of rectangular projections 132 as shown in FIGS. 9 and 10. The rectangular projections 132 can be formed as by plastic molding during the manufacturing stage. The plurality of rectangular penetrations 128 formed in the punch blades 124 shown in FIG. 11 correspond in number and position to the plurality of rectangular projections 132 shown in FIGS. 9 and 10. In addition, the lower interior surface 130 of the cylindrical inner housing 110 is fashioned as by plastic molding to include an annular shoulder or shelf 134 also shown in FIGS. 9 and 10. The annular shoulder 134 is employed to provide support to the punch blades 124 particularly during insertion of the punch blades 124 into the top lid 106 of the paint container 102. Thus, the annular shoulder 134 is intended to prevent vertical movement of the punch blades 124 inside of the cylindrical inner housing 110 during use of the pouring spout 100 by providing a bearing surface for the punch blades 124 to reduce the mechanical shear load on the cylindrical inner housing 110.

Figure 13:
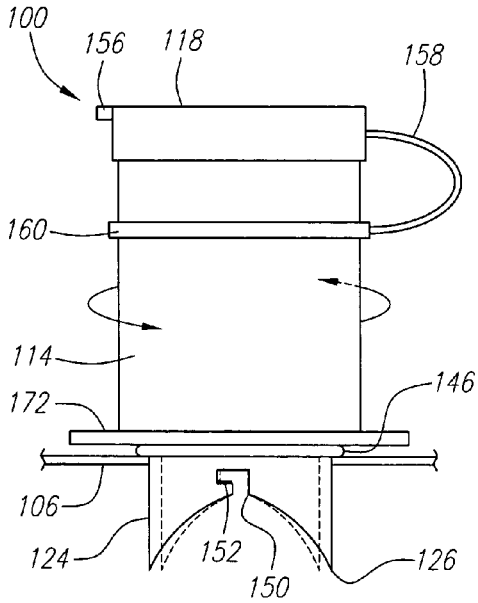
FIG. 13 is an elevation of the pouring spout of FIG. 2 showing the stabilizer flange mounted upon and the stainless steel punch blades extending through the paint can lid, the seal washer shown between the stabilizer flange and the paint can lid, opposing arrows indicating the direction of rotation required to engage and disengage the locking notches with the paint can lid.

During installation of the punch blades 124 as shown in FIG. 11 into the lower interior surface 130 of the cylindrical inner housing 110, the flexibility of the single piece of stainless steel sheet metal enables the rectangular penetrations 128 formed therein to be aligned with and mounted over the corresponding rectangular projections 132 formed in cylindrical inner housing 110. The flexible spring-like character of the stainless steel, sheet metal enables the punch blades 124 to expand within the lower interior surface 130 of the cylindrical inner housing 110. The punch blades 124 are then firmly held in position during use including (a) the vertical position as a result of abutting the annular shoulder 134 shown in FIGS. 9 and 10, and including (b) the rotational position as a result of rotation of the pouring spout 100 as indicated in FIG. 13. Thus, the punch blades 124 are firmly held in position because the rectangular penetrations 128 are fitted over the corresponding rectangular projections 132. This arrangement will cause the punch blades 124 to be held static during insertion and withdrawal movements and during twisting movements of the pouring spout 100.

In an alternative attachment scheme, the punch blades 124 can be secured to the lower interior surface 130 of the cylindrical inner housing 110 by employing a plurality of fasteners (not shown) including but not limited to screws and rivet type fasteners (not shown). The fasteners (not shown) would, for example, penetrate both the lower interior surface 130 of the cylindrical inner housing 110 and the single piece of stainless steel sheet metal as shown in FIG. 11 for securing the punch blades 124 to the bottom portion of the pouring spout 100. In this alternative method, the punch blades 124 would be securely attached to the cylindrical inner housing 110 and prevented from separating from the pouring spout 100 during installing and withdrawing of the punch blades 124, and during rotating motions of the pouring spout 100 for locking it into position once installed in the top lid 106 of the paint container 102.

Figure 14:
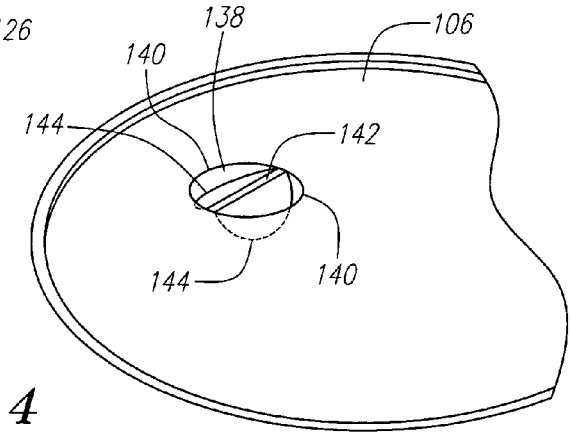
FIG. 14 is a perspective view of the top surface of the paint can lid after withdrawing the pouring spout of FIGS. 2 and 12 showing a pair of half moon shaped or D-shaped openings formed by the cooperation of the pair of stainless steel opposing punch blades and the corresponding pair of projection spurs.

Each of the pair of opposing stainless steel punch blades 124 includes a projection spur 136 formed on the surface of the punch blade 124 as is clearly shown in FIGS. 8, 9, 10, 11 and 12. Each projection spur 136 functions in combination with the punch blades 124 to provide a pair of D-shaped or half-moon, shaped openings 138 in the top lid 106 of the paint container 102 as shown in FIGS. 12 and 14. Each of the projection spurs 136 is formed by piercing each of the respective punch blades 124 with a piercing tool (not shown) as is known in the art. Thus, each projection spur 136 is a stainless steel fragment extending from the corresponding, stainless steel punch blade 124 as is best shown in the cross-sectional views of FIGS. 9 and 10. During insertion of the pair of punch blades 124 of the pouring spout 100 into the top, lid 106 of the paint container 102, a pair of semi-circular, cuts or slices 140 are formed as shown in FIG. 14. A portion of the metal comprising the top lid 106, i.e., a center strip or bridge 142, exists between the pair of semi-circular cuts 140 as is best shown in FIG. 14. The center strip 142 is not cut or sliced by the punch blades 124. As the punch blades 124 travel down through the top lid 106 and form the semi-circular cuts 140 therein, each corresponding projection spur 136 physically contacts and forces downward a D-shaped or half-moon shaped flap 144 located between each semicircular cut 140 and the center strip 142. This action forms the D-shaped or half-moon shaped openings 138 in the lid 106 which function as dispensing ports for the paint 104 contained within the paint container 102.

Positioned between the raised ring 120 and the top lid 106 of the paint container 102 is a seal washer 146 shown in FIGS. 8, 9 and 10. The raised ring 120 which is formed as by molding onto the cylindrical inner housing 110 is shown clearly on FIGS. 8 and 10. The top lid 106 of the paint container 102 is also shown in FIG. 10. The function of the seal washer 146 is to prevent leakage of paint at the interface where the cylindrical inner housing 110 meets the top lid 106. The seal washer 146 is annular in shape and physically wraps about the pair of punch blades 124 as is shown clearly in FIG. 8.

Each of the pair of opposing stainless steel punch blades 124 can also include a locking notch 150 formed into the structure thereof for enabling each of the punch blades 124 to bite into the top lid 106 of the paint container 102 for providing a more secure grip between the pouring spout 100 and the paint container 102. Each of the locking notches 150 is integrally formed, i.e., cut, into the respective punch blade 124 and can be generally rectangular in shape as shown in FIGS. 7, 8, 9, 10, 11 and 13. Further, each locking notch 150 can include a serrated edge 152 to assist the respective punch blade 124 to bite into the center strip 142 formed in the top lid 106 of the paint container 102 after insertion of the punch blades 124.

In particular, once the punch blades 124 have been inserted into the top lid 106 and the seal washer 146 is seated on the top lid 106 to prevent leakage, the entire pouring spout 100 is rotated in the clockwise direction for about one-eighth of a revolution. This action enables the serrated edge 152 of each locking notch 150 to bite into the metal surface of the center strip 142 which assists in keeping the locking notch 150 engaged therewith. Under these conditions, the paint container 102 can be turned upside-down for pouring the paint 104 into a second container such as a roller pan (not shown). In order to remove the punch blades 124 from the top lid 106 of the paint container 102, the process is reversed. The entire pouring spout 100 is rotated approximately one-eighth of a rotation in the counter-clockwise direction to release the serrated edges 152 of the locking notches 150 from the center strip 142. Then the punch blades 124 are forcible withdrawn from the top lid 106 of the paint container 102. The pouring spout 100 is now available for use with the next paint container 102.

The tethered removable cap 118 is shown clearly in FIGS. 1–10, 12 and 14 and is typically employed to close the open top end 112 of the cylindrical inner housing 110 after the punch blades 124 of the pouring spout 100 have been inserted into the top lid 106. When fitted, the removable cap 118 is placed over the anti-drip collar 116 as is shown in FIGS. 6, 7, 9 and 10. The inside of the removable cap 118 includes a small lip 154 for snapping over the bead construction of the anti-drip collar 116 as is shown best in FIGS. 4 and 5. The anti-drip collar 116 includes sufficient thickness so that some manual force is necessary to apply the small lip 154 of the removable cap 118 onto the collar 116 for closing the open top end 112. This design keeps the removable cap 118 securely attached to the anti-drip collar 116 until the cap 118 is physically removed. The removable cap 118 also includes a small hand pull tab 156 for assisting in removing and installing the cap 118 as it relates to the open top end 112. Further, the removable cap 118 includes a tether lead 158 which connects the removable cap 118 to a retainer ring 160 as is clearly shown in FIG. 8. The retainer ring 160 is securely wrapped about the outer safety sleeve 114 as is clearly shown in FIGS. 1–7, 9–10 and 12–13. Thus, the retainer ring 160 travels along the vertical path of the cylindrical inner housing 110 with the outer safety sleeve 114. Each of these components described immediately above can be comprised of plastic material.

Figure 5:
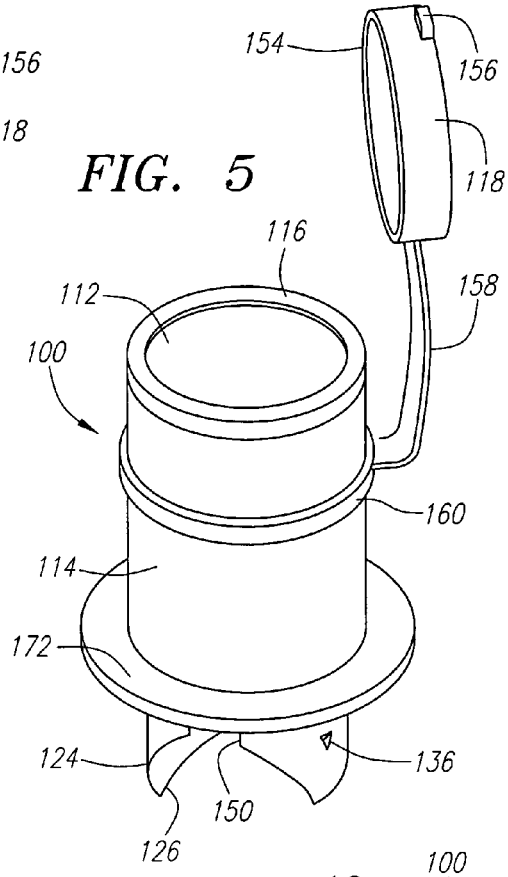
FIG. 5 is a fifth perspective view of the pouring spout of FIG. 1 showing the cylindrical inner housing in the lowered position with a pair of stainless steel opposing punch blade extending down below the outer safety sleeve and stabilizer flange, the removable cap shown in the open position.
Figure 6:
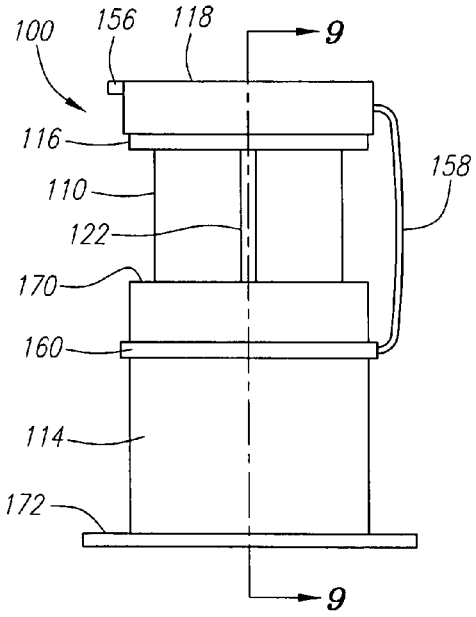
FIG. 6 is an elevation of the pouring spout of FIG. 4 showing the cylindrical inner housing withdrawn above the safety sleeve and stabilizer flange, the tethered removable cap shown in the closed position.
Figure 7:
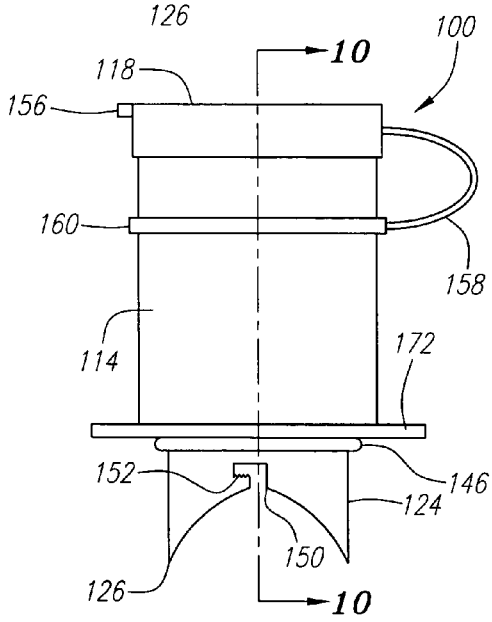
FIG. 7 is an elevation of the pouring spout of FIG. 5 showing the cylindrical inner, housing in the lowered position with the pair of stainless steel opposing punch blades extending down below the outer safety sleeve and stabilizer flange, the removable cap shown in the closed position.

The pouring spout 100 of the present invention is fitted with the outer safety sleeve 114 for covering the pair of opposing punch blades 124 when the pouring spout 100 is not in use. The construction of the outer safety sleeve 114 will now be disclosed. The drawing Figs. clearly disclose that the outer safety sleeve 114 fits over the cylindrical inner housing 110, i.e., the cylindrical inner housing 110 fits within the outer safety sleeve. The outer safety sleeve 114 is a safety feature built into the pouring spout 100 to prevent persons from coming into contact with the pointed ends 126 of the punch blades 124 when the pouring spout 100 is not in use. The outer safety sleeve 114 serves as a protective shroud to enable persons coming into contact with the pouring spout 100 to avoid injury. The outer safety sleeve 114 is cylindrical in shape and is clearly shown in FIGS. 1–10, 12 and 13 but shown best in the exploded view of FIG. 8. The outer safety sleeve 114 can be formed of plastic and is designed to travel up-and-down the length of the cylindrical inner housing 110 as is clearly shown in FIGS. 4–7. The outer safety sleeve 114 is intended to remain mounted upon the cylindrical inner housing 110. However, when the safety sleeve 114 is in the raised position as shown in FIGS. 5, 7 and 10, the pair of punch blades 124 are exposed, and when the safety sleeve 114 is in the lower position as shown in FIGS. 4, 6 and 9, the punch blades 124 are covered or shrouded.

The outer safety sleeve 114 is shown separated from the cylindrical inner housing 110 in the exploded view of FIG. 8. The cylindrically-shaped outer safety sleeve 114 includes a top ring 170 and a bottom stabilizer flange 172. The top ring 170 is interiorly and orthogonally formed at the apex or top of the main cylindrical body of the safety sleeve 114 and includes an interior facing ledge 174. Thus, the diameter of the top ring 170 at the interior facing ledge 174 is smaller than the diameter of safety sleeve 114 as is clearly shown in FIG. 8. Formed in the inside circumference of the top ring 170, i.e., within the interior facing ledge 174, is a plurality of slots 176 wherein the position and number of slots 176 correspond to the position and number of guide ribs 122 formed on the exterior surface of the cylindrical inner housing 110. It is noted that the slots 176 are formed only in the top ring 170 of the safety sleeve 114, i.e., the slots 176 do not extend down inside the interior surface of the main body of the safety sleeve 114. Since the position and number of the slots 176 correspond to the position and number of the guide ribs 122, the guide ribs 122 ride inside of the slots 176 of the top ring 170 when the safety sleeve 114 travels along the vertical dimension of the cylindrical inner housing 110. This feature is shown clearly in FIG. 4. Since the slots 176 formed in the top ring 170 do not extend along the inner vertical dimension of the safety sleeve 114, the guide ribs 122 formed on the outer surface of the cylindrical inner housing 110 rub against the inner surface of the safety sleeve 114 to provide an "interference fit". The function of this "interference fit" is to position and center the cylindrical inner housing 110 within the outer safety sleeve 114, i.e., this construction holds the cylindrical inner housing 110 to the safety sleeve 114.

With continued reference to the top ring 170 of the safety sleeve 114 shown in FIG. 8, the diameter of the top ring 170 at the interior facing ledge 174 is smaller than the diameter of safety sleeve 114. A dotted line 178 located between the outer boundary of the top ring 170 and the interior facing ledge 174 represents the inner wall of the outer sleeve 114. Thus, the differential distance between the dotted line 178 and the inner edge of the interior facing ledge 174 represents the horizontal dimension of the interior facing ledge 174, i.e., the differential distance describes how far the interior facing ledge 174 extends inward and beyond the inner wall of the outer sleeve 114. Note that the diameter of the top ring 170 at the interior facing ledge 174 is sufficiently wide to pass over the exterior surface of the cylindrical inner housing 110. Simultaneously, the guide ribs 122 formed on the cylindrical inner housing 110 ride within the plurality of slots 176 formed within the top ring 170. Further note that the raised ring 120 is formed as by molding onto the bottom of the cylindrical inner housing 110 as is clearly shown in FIG. 8 and that the raised ring 120 extends outward from the cylindrical inner housing 110 by the same dimension as that of the guide ribs 122. Thus, when the safety sleeve 114 travels to the bottom of the cylindrical inner housing 110, the interior facing ledge 174 of the top ring 170 fails to pass over the raised ring 120. This feature prevents the outer safety sleeve 114 from separating from the cylindrical inner housing 110 at the bottom end of the cylindrical inner housing 110. Under these conditions, the safety sleeve 114 is in the lower position for shrouding the punch blades 124 as is shown in FIGS. 4 and 6.

When a downward vertical force is applied to the pouring spout 100 and the punch blades 124 are being inserted into the top lid 106 of the paint container 102, the cylindrical inner housing 110 is moving downward but the outer safety sleeve 114 is moving upward as is shown in FIGS. 9 and 10. By design, the vertical height of the outer safety sleeve 114 is abbreviated, i.e., shorter, than the vertical height of the cylindrical inner housing 110. Thus, during installation of the punch blades 124 into the top lid 106, the seal washer 146 positioned beneath the raised ring 120 will contact the top lid 106 before the top ring 170 of the outer safety sleeve 114 contacts the anti-drip collar 116 at the open top end 112 of the cylindrical inner housing 110. In this manner, the upward vertical travel of the safety sleeve 114 does not interfere with the anti-drip collar 116 or the tethered removable cap 118, when fitted.

The stabilizer flange 172 is located at the bottom of the outer safety sleeve 114 as shown in FIGS. 4, 5 and 8 and assists the pouring spout 100 to be vertically positioned on the top lid 106 prior to the installation of the punch blades 124 as shown in FIG. 1. After the downward force is applied to the removable cap 118 and the punch blades 124 have pierced the top lid 106, the stabilizer flange 172 sits flush on the top lid 106 of the paint container 102 as is shown in FIGS. 2 and 13. After installation, the stabilizer flange 172 provides rigidity to the interface of the pouring spout 100 and the top lid 106. When the outer safety sleeve 114 is in the raised position, the stabilizer flange 172 is positioned above the punch blades 124 as shown in FIGS. 5, 7 and 10. However, when the pouring spout 100 is not in use, the stabilizer flange 172 is lowered and completely covers the punch blades 124 as well as the raised ring 120 and the seal washer 146 as shown in FIGS. 4, 6 and 9.

During operation, the inventive pouring spout 100 is placed on the top lid 106 of the paint container 102 at the desired location for insertion. The stabilizer flange 172, which covers the punch blades 124, is positioned flat on the top lid 106. The cylindrical inner housing 110 extends above the stabilizer flange 172 as is shown in FIG. 1. The tethered removable cap 118 is then fitted onto the anti-drip collar 116 so that it can be utilized as a means for applying force to the punch blades 124 via the cylindrical inner housing 110. While steadying the pouring spout 100 with one hand (as by holding the body of the safety sleeve 114), a downward force is applied with the users free hand to the top of the removable cap 118. The downward force transmitted to the punch blades 124 through the cylindrical inner housing 110 causes the punch blades 124 to pierce the top lid 106 of the paint container 102. As the cylindrical inner housing 110 travels downward due to the applied force, the outer safety sleeve 114 effectively travels up the cylindrical inner housing 110 as the guide ribs 122 pass through the corresponding slots 176 formed in the top ring 170. The projection spurs 136 formed on the punch blades 124 forcibly open the top surface 106 of the paint container 102 as shown in FIGS. 10 and 14. The inserted pouring spout 100 is shown in FIG. 2.

Once the stainless steel punch blades 124 pierce the top lid 106, the outer safety sleeve 114 is grasped and twisted approximately one-eighth of a turn in the clockwise direction as shown in FIG. 13. This applied rotary torque enables the serrated edge 152 of each of the locking notches 150 to bite into the center strip 142 of the paint container 102 as shown in FIG. 10. Since the guide ribs 122 formed on the exterior surface of the cylindrical inner housing 110 ride in the corresponding slots 176 formed in the top ring 170 of the safety sleeve 114, the rotary motion applied to the safety sleeve 114 is transferred to the cylindrical inner housing 110. This action provides the necessary torque to rotate the punch blades 124. The combination of the locking notches 150 and the stabilizer flange 172 lock the pouring spout 100 into position. The paint container 102 can now be tilted as necessary for pouring paint 104 into a second container such as a roller pan (not shown). Upon completion of the pouring process, the paint container 102 is up-righted and the removable cap 118 is fitted to the anti-drip collar 116 for storage. In the alternative, a reverse torque is applied to the safety sleeve in the counter-clockwise direction for approximately one-eighth of a turn to release the locking notches 150. The punch blades 124 are then forcibly withdrawn.

In summary, the pouring spout 100 of the present invention provides a conduit for the discharge of the contents of a closed container containing, for example, fluids or granulated materials and enables measured volumes thereof to be removed from the closed container. In its most fundamental embodiment, the pouring spout 100 includes a cylindrical inner housing 110 having an open top end 112 and a removable tethered cap 118. A pair of opposing punch blades 124 affixed to the cylindrical inner housing 110 is provided for insertion into a top lid 106 of a paint container 102 where the cylindrical inner housing 110 and the punch blades 124 serve to provide a discharge conduit for the container 102. A projection spur 136 is formed on each of the punch blades 124 for forcing open the top lid 106 of the container 102. An outer safety sleeve 114 is provided for covering the punch blades 124 when the punch blades 124 are withdrawn from the top lid 106 of the container 102.

The present invention provides novel advantages over other pouring devices known in the prior art. A main advantage of the pouring spout 100 is that it includes (1) a pair of opposing stainless steel punch blades 124 for piercing the top lid 106 of the paint container 102, where (2) the punch blades 124 each include a projection spur 136 to open the top lid 106 and a locking notch 150 with a serrated edge 152 to enable each punch blade 124 to be securely attached to the top lid 106 once installed. The combination further includes the advantage of (3) an outer safety sleeve 114 employed to cover or shroud the pointed ends 126 of the punch blades 124 to minimize possible injury to persons when the pouring spout 100 is not in use and (4) a combination of guide ribs 122 and corresponding slots 176 formed in the top ring 170 of the safety sleeve 114 to maintain alignment of the components and to transfer rotary force as required for proper installation of the pouring spout 100.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention.

What is claimed is:

1. A pouring spout for use with a closed container containing building materials comprising:

a cylindrical inner housing having an open top end and a removable tethered cap;

a pair of opposing punch blades affixed to said cylindrical inner housing for insertion with a downward force into a top surface of a container, said cylindrical inner housing and said punch blades for providing a discharge conduit for said container;

a projection spur formed on a surface of each of said punch blades for forcing open said top surface of said container; and an outer safety sleeve being vertically movable over said cylindrical inner housing for covering said punch blades when said punch blades are withdrawn from said top surface of said container.

2. The pouring spout of claim 1 wherein said cylindrical inner housing comprises an anti-drip collar.

3. The pouring spout of claim 1 wherein said cylindrical inner housing comprises a plurality of guide ribs for cooperating with said outer safety sleeve.

4. The pouring spout of claim 1 wherein said cylindrical inner housing is comprised of plastic.

5. The pouring spout of claim 1 wherein said tethered cap includes a retainer ring that surrounds said cylindrical inner housing.

6. The pouring spout of claim 1 wherein each of said opposing punch blades is comprised of stainless steel sheet metal.

7. The pouring spout of claim 1 wherein each of said projection spurs is comprised of stainless steel sheet metal and each is formed by piercing said respective surface on each of said punch blades.

8. The pouring spout of claim 1 wherein said outer safety sleeve includes a cylindrical plastic construction.

9. The pouring spout of claim 1 wherein said outer safety sleeve includes a stabilizer flange for enabling said pouring spout to stand vertically when not in use.

10. The pouring spout of claim 1 further including a raised ring formed on said cylindrical inner housing for stopping said cylindrical inner housing at said top surface of said container.

11. The pouring spout of claim 1 further comprising a seal washer positioned between a raised ring formed on said cylindrical inner housing and said top surface of said container.

12. The pouring spout of claim 1 further including a bearing surface formed within said cylindrical inner housing for supporting said opposing punch blades.

13. A pouring spout for use with a closed container containing building materials comprising:

a cylindrical inner housing having an open top end and a removable tethered cap;

a pair of opposing punch blades affixed to said cylindrical inner housing for insertion with a downward force into a top surface of a container, said cylindrical inner housing and said punch blades for providing a discharge conduit for said container;

a locking notch integrally formed in each of said opposing punch blades for securing said punch blades to said top surface of said container; and an outer safety sleeve for covering said punch blades when said punch blades are withdrawn from said top surface of said container, said safety sleeve being vertically moveable over said cylindrical inner housing.

14. The pouring spout of claim 13 wherein each of said locking notches comprises a serrated edge.

15. The pouring spout of claim 13 wherein each of said locking notches is rectangular-shaped.

16. A pouring spout for use with a closed container containing building materials comprising:

a cylindrical inner housing having an open top end and a removable tethered cap;

a pair of opposing punch blades affixed to said cylindrical inner housing for insertion with a downward force into a top surface of a container, said opposing punch blades having a plurality of penetrations formed there through for cooperating with a corresponding plurality of projections formed within said cylindrical inner housing, said cylindrical inner housing and said punch blades for providing a discharge conduit for said container; and an outer safety sleeve for covering said punch blades when said punch blades are withdrawn from said top surface of said container, said safety sleeve being vertically moveable over said cylindrical inner housing.

17. The pouring spout of claim 16 wherein said cylindrical inner housing comprises a plurality of vertical guide ribs formed thereon.

18. The pouring spout of claim 16 wherein said safety sleeve further includes a top ring having a plurality of slots formed therein.

19. The pouring spout of claim 16 wherein said safety sleeve further includes a top ring having a plurality of slots formed therein for cooperating with a plurality of vertical guide ribs formed on said cylindrical inner housing.

20. The pouring spout of claim 16 wherein said plurality of projections formed within said cylindrical inner housing is comprised of plastic.

* * * * *